US006205801B1

(12) United States Patent
Riglos et al.

(10) Patent No.: US 6,205,801 B1
(45) Date of Patent: Mar. 27, 2001

(54) ROOM AIR CONDITIONER WITH TIMER CONTROLLED AUXILIARY POWER PLUG

(75) Inventors: Benedicto B. Riglos, Muntinlupa; Edward J. Esporlas, Sta. Mesa Metro Manila; Jacinto S. Castro, Jr., Bacoor Cavite, all of (PH)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/303,230

(22) Filed: Apr. 30, 1999

(51) Int. Cl.[7] ..... F25B 19/00
(52) U.S. Cl. ..... 62/231; 62/201; 62/262
(58) Field of Search ..... 62/231, 262, 454, 62/201

(56) References Cited

U.S. PATENT DOCUMENTS

| | | | | |
|---|---|---|---|---|
| 3,949,366 | | 4/1976 | Spillar et al. | 340/171 |
| 4,041,723 | | 8/1977 | Weibel et al. | 62/126 |
| 4,144,930 | * | 3/1979 | Ferdelman | 165/12 |
| 5,582,233 | * | 12/1996 | Noto | 165/247 |
| 5,634,346 | | 6/1997 | Ramakrishnan et al. | 62/89 |

* cited by examiner

*Primary Examiner*—Corrine McDermott
*Assistant Examiner*—Malik N. Drake

(57) ABSTRACT

According to the present invention, an air conditioning unit includes means for supplying electrical power to electrically operated components within the unit. The unit includes a control device for controlling the delivery of electrical power from the supply so as to selectively energize the electrically operated components. An electrical supply socket of the type suitable for receiving a household appliance power cord plug is provided. A timer device is configured to receive electrical power from the electrical power supply. The timer is operable to be set to an "on" condition at selected time and an "off" condition at another selected time. An electrical circuit interconnects the control and the timer such that when the timer is in its "on" condition, electrical power to the electrically operated components is controlled by the control. When the timer is in its "off" condition, electrical power may not be delivered to the electrically operated components and is delivered to the electrical supply socket.

7 Claims, 4 Drawing Sheets

ROOM AIR CONDITIONER WITH TIMER CONTROLLED AUXILIARY POWER PLUG

BACKGROUND OF THE INVENTION

This invention relates to a self-contained room air conditioner unit of the type which has a built in timer for turning the unit on and off at preset times. When the timer is in the off position, it actuates an auxiliary electrical plug, which a standard electric fan may be plugged into.

The operation of room air conditioners by a built in electric clock timer, which is adapted to turn the unit "on" and "off" at preset times is well known. One such arrangement is disclosed, for example, in U.S. Pat. No. 4,041,723 to Weibel, Jr. et al. While the '723 patent illustrates a mechanical timer for achieving the on/off cycling, U.S. Pat. No. 5,634,346, "Apparatus and Method for Controlling a Room Air Conditioner" to Ramakrishnan et al. describes a room air conditioner having an electronic control, which provides the same on/off cycling capability. Prior art room air conditioners are also well known to have a "fan only" operating mode in which the compressor of the air conditioning unit is not energized and the unit serves as an air circulator. In such mode, the air conditioner fan motor, which typically runs both the evaporator and condenser fans is actuated and causes air to flow through both the indoor, air conditioning, path, and the outdoor path through the condenser heat exchanger.

Such fan only operation, accordingly, is capable of providing limited air circulation at a relatively high level of power consumption, as the motor is sized to run both the indoor and the outdoor fans. It is, accordingly, deemed desirable to have the capability to actuate a conventional electric circulating and cooling fan when a room air conditioner is not being operated in the cooling mode with both the compressor and fan motors actuated.

SUMMARY OF THE INVENTION

An object of the present invention is a room air conditioner having a timer, which selectively provides electrical power to the control circuits for the compressor and fan motor, or to an auxiliary power plug.

Another object of the invention is a timer controlled room air conditioner having a timer controlled auxiliary power plug, which is located in the electrical plug of the air conditioner's service cord.

Yet another object of the invention is a timer controlled room air conditioner having an auxiliary plug, which is energized when the air conditioner is not energized by the timer and into which a standard electric fan is plugged into and energized.

According to the present invention, an air conditioning unit includes means for supplying electrical power to electrically operated components within the unit. The unit includes a control device for controlling the delivery of electrical power from the supply so as to selectively energize the electrically operated components. An electrical supply socket of the type suitable for receiving a household appliance power cord plug is provided. A timer device is configured to receive electrical power from the electrical power supply. The timer is operable to be set to an "on" condition at selected time and an "off" condition at another selected time. An electrical circuit interconnects the control and the timer such that when the timer is in its "on" condition, electrical power to the electrically operated components is controlled by the control. When the timer is in its "off" condition, electrical power may not be delivered to the electrically operated components and is delivered to the electrical supply socket.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
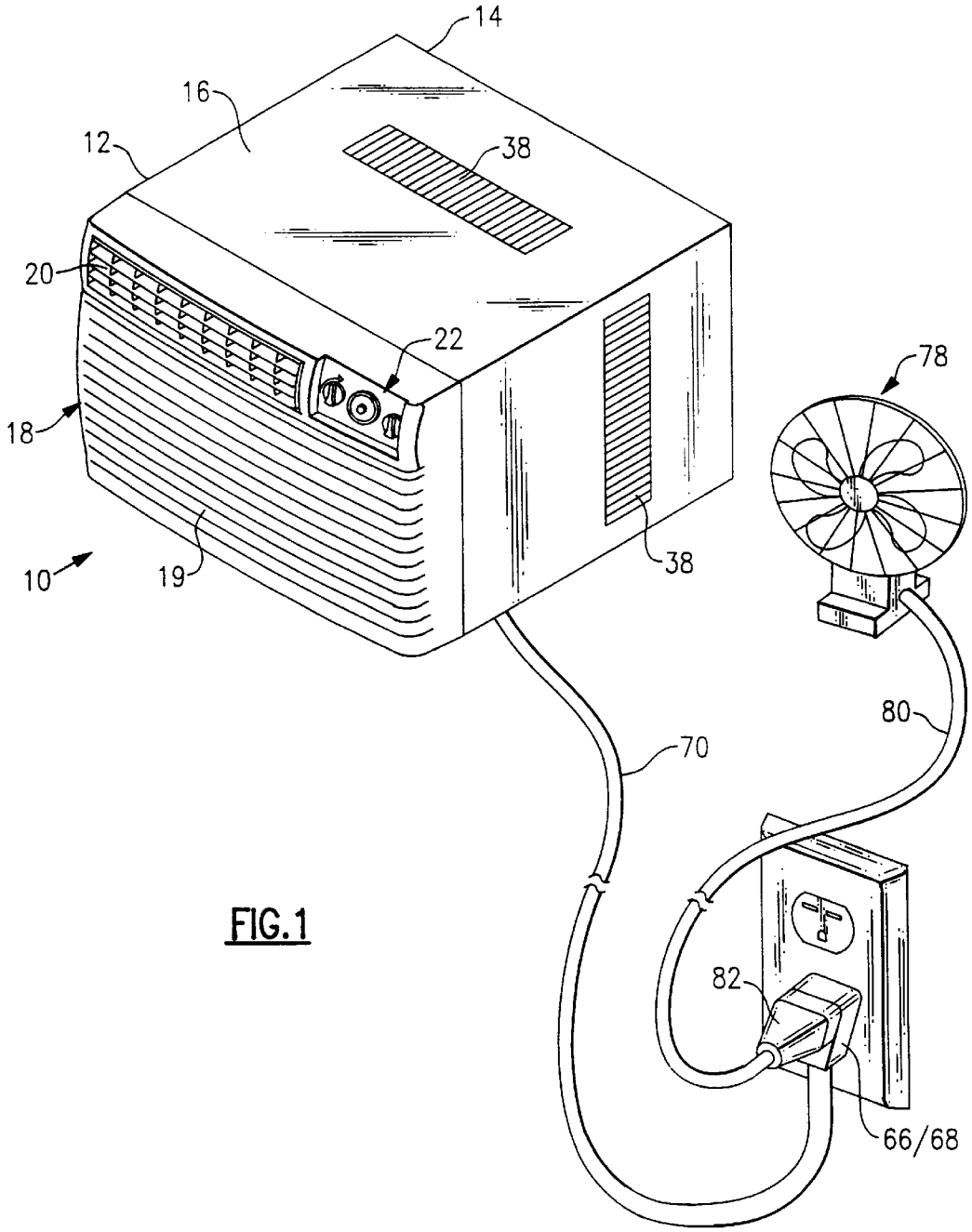
FIG. 1 is a perspective view of a room air conditioner embodying the features of the present invention.

FIG. 1 illustrates a room air conditioning unit 10, which includes generally an indoor section 12 and an outdoor section 14. The air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille 18, which includes inlet louvers 19 and an air discharge assembly 20. The front grille 18 also includes a control panel 22 for the unit in the upper right-hand corner thereof.

Figure 3:
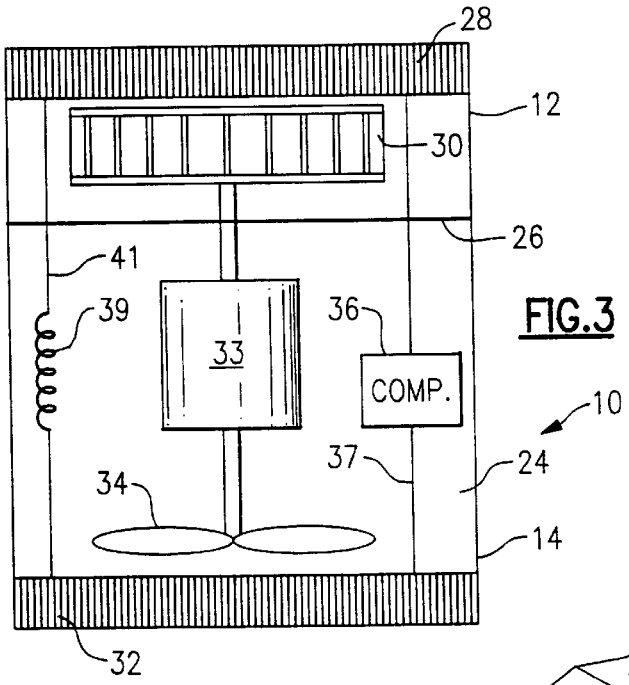
FIG. 3 is a diagrammatic view of an air conditioning unit.

As seen in FIG. 3, the components of both indoor section 12 and outdoor section 14 are supported in a rectangular base pan 24. The indoor and outdoor sections are separated by a vertically extending partition 26. The indoor section includes, basically, an evaporator coil 28 vertically disposed at the front end thereof, and an evaporator or indoor fan 30.

The outdoor section 14 includes a condenser coil 32 vertically disposed adjacent the back end thereof and a condenser fan 34 located adjacent the condenser coil. The indoor fan 30 and the condenser fan 34 are both operated by an electric fan motor 33 located in the outdoor section 14. Also located in the outdoor section 14 is an electric motor driven refrigerant compressor 36, which is connected by refrigerant line 37 in series flow relationship with the condenser 32, and an expansion device 39 in line 41 to the evaporator 28, which in turn is connected to the inlet of the compressor.

During operation, air from the space to be conditioned by the unit is drawn by action of the indoor fan 30 through the inlet louvers 19 and is directed through the evaporator coil 28 where the air is cooled. The cooled air is then directed by a suitable scroll (not shown) back into the room to be cooled through the air discharge assembly 20. At the same time, ambient air is drawn through inlets 38 in the outside section of the housing 16, across the condenser coil 32 for cooling, by operation of the condenser fan 34.

Figure 2:
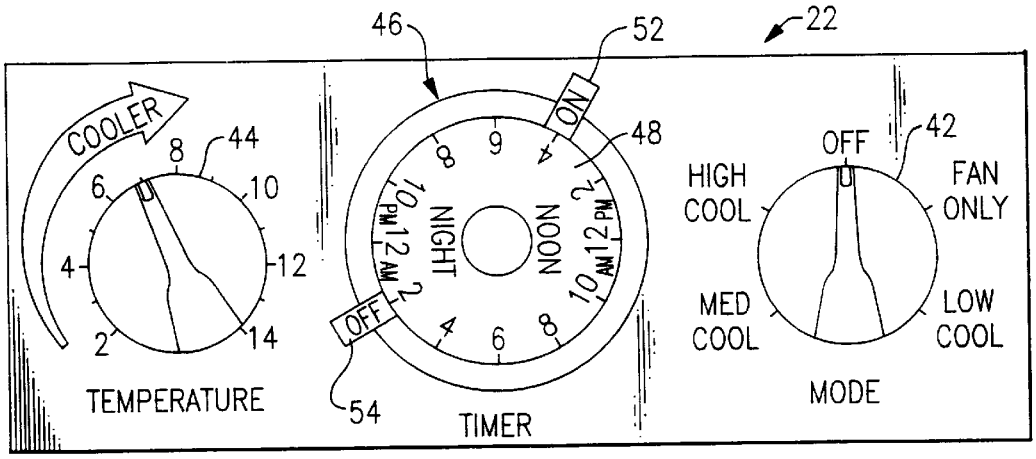
FIG. 2 is a fragmentary enlarged view of the room air conditioner control panel.

As best seen in FIG. 2, the control panel 22 includes a rotatable selector switch knob 42, which is operable to an "off" position, three cooling positions and a "fan only" position. Mounted on the left side of the control panel 22 is a temperature control thermostat knob 44, which is operable to a plurality of positions to set the desired temperature for the room being cooled. Mounted on the control panel between the selector and temperature knobs is a timer 46. The illustrated timer is typical of mechanical timers well known for use with window room air conditioners for providing a timed on/off capability to the air conditioning unit. It should be understood that electronic timers are also well known in the art and would also be suitable for use in connection with the present invention.

The basic principles of operation of the electromechanical timer 46 illustrated, in FIG. 2, are as follows: the circular time dial 48 is connected to a timer motor 50 (see FIG. 5), which causes the dial 48 to rotate once in a twenty-four hour period. Positioned circumferentially around the dial 48 is a track on which moveable "on" and "off" indicators 52 and 54 are mounted. The on and off indicators 52 and 54 have actuating configurations (not shown) which extend under the central dial 48. Carried by the central dial 48 and its supported mechanism, and again not seen, are on and off actuating mechanism, which when engaged by the corresponding actuating mechanisms of the on and off indicators will cause a switch 56 (see FIG. 5) to move between two positions. In the first or "on" position a circuit is completed which allows delivery of electrical power to the compressor and fan motor 36 and 33 and an "off" position wherein the circuit is interrupted and electrical power cannot be provided to the compressor and fan motor.

Figure 5:
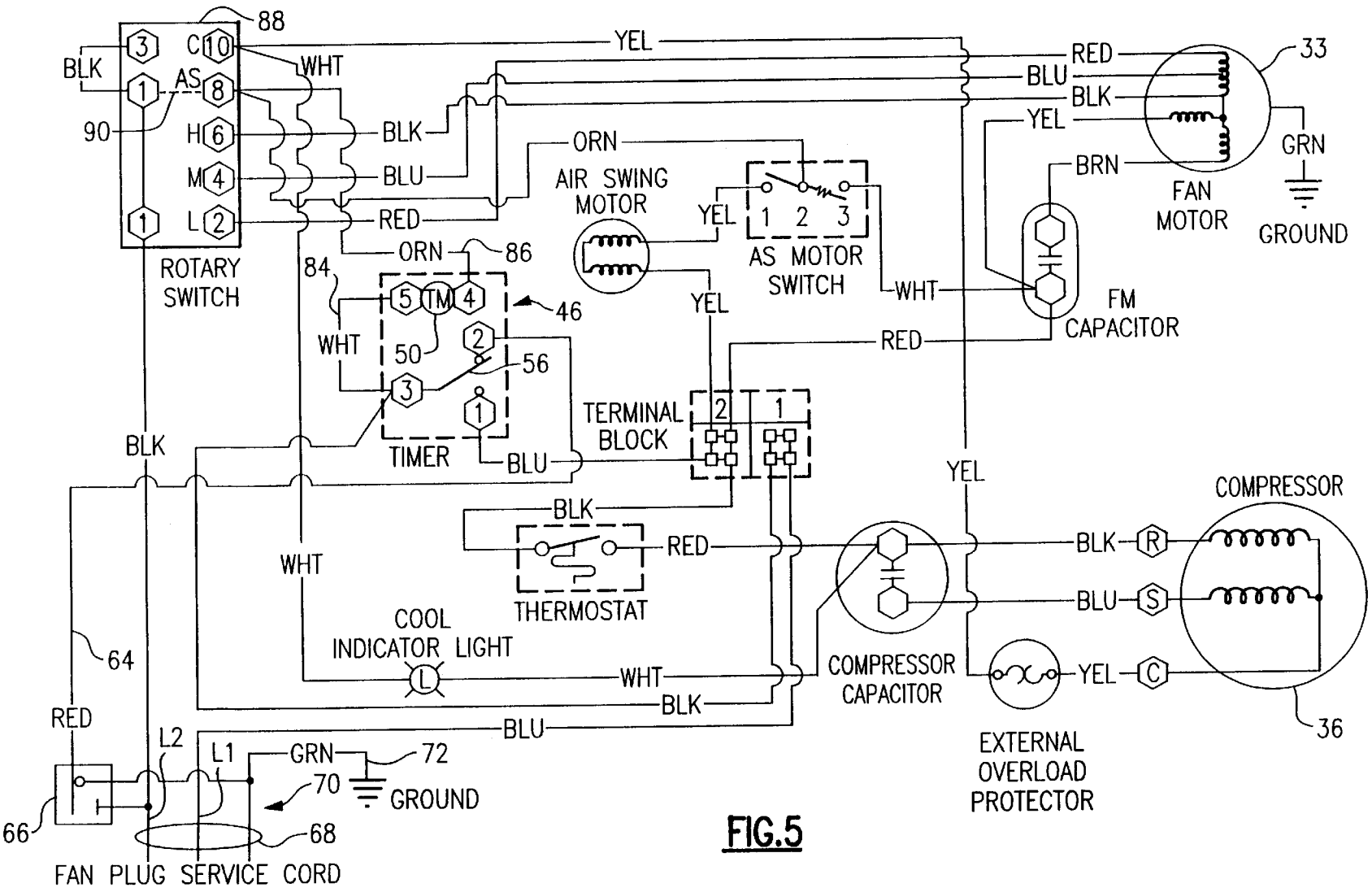
FIG. 5 is a schematic electrical diagram of the air conditioning unit illustrated in FIG. 1.
Figure 6:
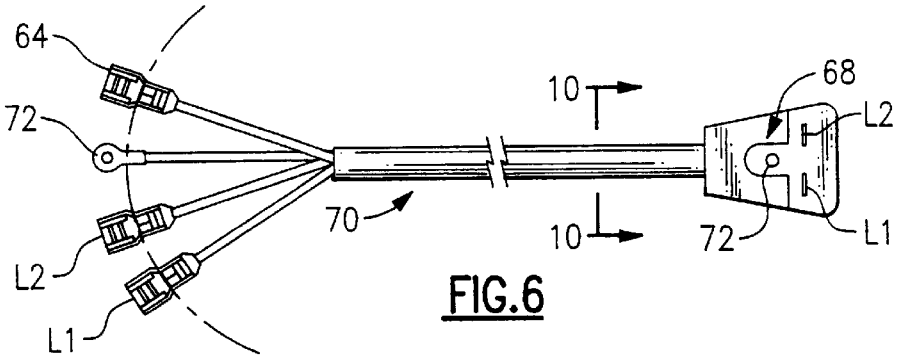
FIG. 6 is an enlarged detailed showing of the power cord of the air conditioning unit illustrated in FIG. 1.

The above-described on/off switch is indicated by reference numeral 56 in FIG. 5 in the "off" position with the switch interconnecting the "3" and "2" contact points in the timer. The "on" position of the timer is with the points "3" and "1" interconnected by the contact 56. It will be noted that with the switch in the "on" position, supply conductor L1 from the service cord 70 will complete a circuit through terminal block "1", contact point "3" in the timer, contact point "1 " in the timer, terminal block "2", and from there to the fan motor 33, the compressor, via the thermostat 60 and to an air swing motor 62. As so connected and with the selector switch 42 set in an operating position, and the temperature knob 44 set to a desired temperature, the air conditioner will operate under normal operating conditions as controlled by the thermostat setting to provide cool conditioned air to the room.

Figure 4:
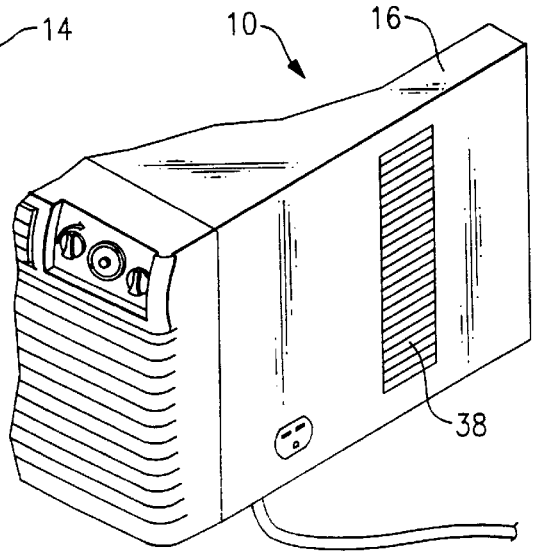
FIG. 4 is a fragmentary view of the right side of an air conditioner similar to that shown in FIG. 1 illustrating another embodiment of the invention.

In prior art room air conditioner systems which are controlled by a timer, the timer contact 56 in the "off" position would simply create an open circuit between timer contact points "3" and "1". According to the present invention, as is evident from FIG. 5, the "off" position completes a circuit between the timer contact points "3" and "2". This circuit, when completed, connects the L1 side of the power supply to a conductor 64, which is connected to an auxiliary socket 66 which may be located in the plug 68 of the service cord 70 or, alternatively, in the side of the air conditioner, as illustrated in FIG. 4.

It should be noted that the timer motor 50 is powered at all times when the air conditioning unit 10 is plugged in. The L1 side of the power supply is connected to point "5" of the timer through connector 84, which is connected at its other end to point "3". The other contact of the timer, i.e. point "4", is connected through connecting wire 86 to point "8" on the rotary switch 88, which is connected via an internal connector 90 to point "1" of the switch, which is in direct contact with L2 of the power supply.

Figure 7:
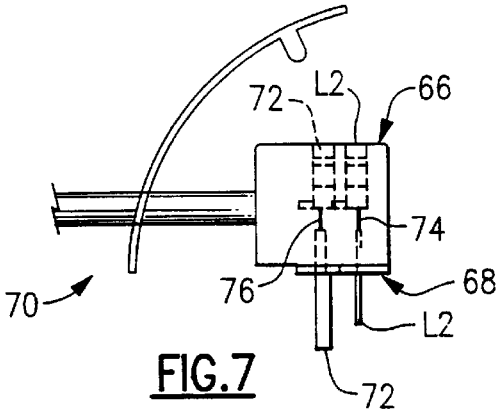
FIG. 7 is an enlarged side view of the plug end of the cord illustrated in FIG. 6.
Figure 8:
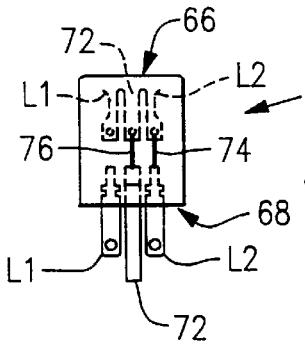
FIG. 8 is a right-side view of the plug illustrated in FIG. 7.
Figure 9:
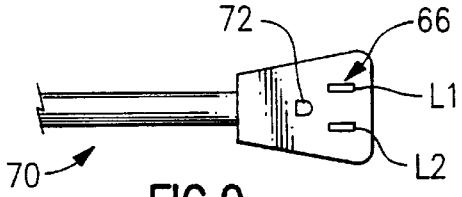
FIG. 9 is a top view of a the plug illustrated in FIG. 6.
Figure 10:
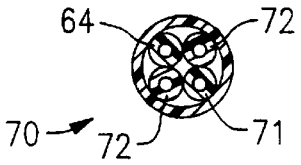
FIG. 10 is a sectional view of the cord illustrated in FIG. 6.

FIGS. 6–10 illustrate the service cord 70 having the conductor 64 and the auxiliary socket 66 incorporated therein in detail. The service cord 70 is provided with four conductors passing therethrough. L1, L2 and a ground connector 72 are conventional. The fourth connector 64, as described above, passes from the timer terminal "2" back to the L1 terminal of the auxiliary socket 66. As is shown in FIGS. 5, 7 and 8, the L2 terminals of the service cord plug 68 and the auxiliary socket 66 are connected to one another by interconnecting wire 74, also the ground terminal 72 of the plug 68 and the ground socket 72 of the auxiliary socket 66 are connected to one another by interconnecting wire 76. Accordingly, when the service cord plug 68 is plugged into a standard household power socket, electrical power is provided to the air conditioner unit by way of L1, L2 and ground 72. With the timer in the air conditioning position "on" contacts "3" and "1" are interconnected, and power is provided to the air conditioning unit for normal operation. With the timer in the air conditioning "off" position with the contacts "3" and "2" interconnected, power supply line L1 to the air conditioning unit is interrupted and the power supply circuit L1 to the auxiliary socket 66 is complete through conductor 64 thereby energizing the auxiliary socket 66 when the timer is in the air conditioner "off" position.

FIG. 1 illustrates a conventional electrically powered electric fan 78 having a service cord 80 with its plug 82 plugged into the auxiliary socket 66. As a result, with the electric fan 78 turned on, the fan 78 will be energized through the auxiliary socket 66 when the timer 46 places the air conditioning unit 10 into its air conditioning "off" mode. Typical operation of the combination air conditioning and fan described above would be to actuate the air conditioner at 4:00 p.m., as indicated by the positioning of the "on" indicator 52 in the timer shown in FIG. 2. This would allow the air conditioner to come on in the afternoon before people return home from work to cool the house down prior to their arrival. The "off" indicator 54 is positioned at 2:00 a.m., representing a time after the residents would have gone to bed and fallen asleep. At this time, the room would be cooled to a comfortable sleeping condition and the air conditioning unit would be shut off by the timer. At the same time, the external fan 78 would be actuated to provide circulation of the cooled air in the room. Such use of the air conditioner and timer would result in significant savings in electrical energy as the compressor and fan motor of the air conditioning unit would consume a considerably greater amount of electrical energy during the nighttime hours than would the electric motor of the auxiliary fan 78. The auxiliary fan 78 would thus operate and provide cooling and air circulation until the next day at 4:00 p.m. when the operating cycle would be repeated.

FIG. 4 illustrates an embodiment where the auxiliary socket 66 is located in the side wall of the air conditioning unit. Such an alternative arrangement would be easily facilitated by locating the interconnecting wire 74 for the line L2 and the interconnecting line 76 for the ground within the air conditioning cabinet. The fourth connector 64 would then not pass back through the service cord 70, but rather directly to the L1 connector in the auxiliary socket 66.

Although the invention has been described in connection with the preferred embodiments, it is not intended to limit the invention's particular form set forth, on the contrary, it is intended to cover such alternatives, modifications, and equivalents that may be included in the spirit and scope of the invention, as defined by the appended claims.

What is claimed is:

1. An air conditioner comprising:

means for supplying electrical power to said air conditioner;

electrically operated components, which are operable when energized by electrical power;

control means for controlling the delivery of electrical power from said electrical power supply means to, and selectively energizing, said electrically operated components;

an electrical supply socket of the type suitable for receiving a household appliance power cord plug;

a timer device configured to receive electrical power from said electrical power supply means, said timer device being operable to set an "on" condition at a selected time, and an "off" condition at another selected time; and circuit means associated with said control means and said timer wherein, when said timer is in said "on" condition, electrical power to said electrically operated components is controlled by said control means, and when said timer is in said "off" condition, electrical power may not be delivered to said electrically operated components, and, electrical power is delivered to said electrical supply socket.

2. The apparatus of claim 1 further including an electric fan external from said air conditioner, said electric fan having a household appliance power cord having a plug received in said electrical supply socket, whereby when said timer is in said "off" condition electric power is delivered to said external electric fan.

3. The apparatus of claim 2 wherein said air conditioner is a window room air conditioner unit.

4. The apparatus of claim 1 wherein said means for supplying electrical power to said air conditioner is an electric service cord having a plug at one end thereof, said plug including contacts configured to be received in a household power socket, and, said plug further incorporating said electrical supply socket therein.

5. The apparatus of claim 4 wherein:

said electric service cord includes four conductors therein, said conductors including first and second power conductors, a ground conductor and a fourth conductor;

said contacts on said service cord plug including, first and second plug power contacts, and a plug ground contact;

said electrical supply socket including first and second socket power contacts, and a socket ground contact;

said first power conductor being electrically connected to said first plug power contact;

said second power conductor being electrically connected to said second plug power contact, and to said second socket power contact;

said ground conductor being electrically connected to said plug ground contact, and to said socket ground contact;

said timer has a power contact which is electrically connected to said first power conductor when said timer is in said "off" condition;

said first socket power connector is electrically connected to one end of said fourth conductor; and the other end of said fourth conductor is electrically connected to said power contact of said timer.

6. The apparatus of claim 5 wherein said air conditioner is a window room air conditioner unit.

7. The apparatus of claim 6 further including an electric fan external from said air conditioner, said electric fan having a household appliance cord having a plug received in said electrical supply socket whereby when said timer is in said "off" condition electric power is delivered to said external electric fan.

* * * * *